US011530590B2

(12) United States Patent
Araujo

(10) Patent No.: US 11,530,590 B2
(45) Date of Patent: Dec. 20, 2022

(54) INTERLOCKING DUAL V-SHAPED SHEAR RAM AND METHOD

(71) Applicant: WORLDWIDE OILFIELD MACHINE, INC., Houston, TX (US)

(72) Inventor: Raul Araujo, Cypress, TX (US)

( * ) Notice: Subject to any disclaimer, the term of this patent is extended or adjusted under 35 U.S.C. 154(b) by 0 days.

(21) Appl. No.: 17/102,828

(22) Filed: Nov. 24, 2020

(65) Prior Publication Data

US 2021/0156217 A1 May 27, 2021

Related U.S. Application Data

(60) Provisional application No. 62/941,246, filed on Nov. 27, 2019.

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/062
See application file for complete search history.

(56) References Cited

U.S. PATENT DOCUMENTS

| | | | | |
|---|---|---|---|---|
| 2,090,206 | A * | 8/1937 | King | E21B 33/062 277/325 |
| 4,132,266 | A * | 1/1979 | Randall | E21B 29/08 137/242 |
| 5,515,916 | A * | 5/1996 | Haley | E21B 29/08 166/55 |
| 2006/0144586 | A1* | 7/2006 | Urrutia | E21B 33/063 166/55 |
| 2017/0145772 | A1* | 5/2017 | Araujo | E21B 29/00 |
| 2018/0283560 | A1* | 10/2018 | Trivedi | E21B 33/063 |
| 2019/0017344 | A1* | 1/2019 | Lambert | E21B 33/0375 |
| 2019/0345790 | A1* | 11/2019 | Nault | E21B 33/064 |
| 2020/0032608 | A1* | 1/2020 | Christopherson | E21B 29/08 |
| 2020/0182005 | A1* | 6/2020 | Pickett | F16J 15/021 |
| 2020/0217167 | A1* | 7/2020 | Armilli | E21B 33/061 |
| 2021/0156216 | A1* | 5/2021 | Strankman | E21B 33/063 |
| 2021/0342507 | A1* | 11/2021 | Song | E21B 33/06 |

* cited by examiner

*Primary Examiner* — Kipp C Wallace
(74) *Attorney, Agent, or Firm* — Kenneth L. Nash; Thomas D. Nash

(57) ABSTRACT

The present invention provides a dual interlocking v-shaped shear ram assembly comprising an upper ram and lower ram, each defining a v-shaped cutting surface. A plurality of angled surfaces on the upper ram and lower ram engage to form an interlocking connection that prevents rotation of either the upper ram or lower ram in the ram cavity and seals the wellbore. The upper ram has a surface along 90% to 100% of the length thereof that conforms to the surface of the corresponding ram cavity.

27 Claims, 9 Drawing Sheets

INTERLOCKING DUAL V-SHAPED SHEAR RAM AND METHOD

BACKGROUND

Field of the Invention

The present invention relates generally to BOP rams and, more particularly, to an interlocking dual v-shaped shear ram BOP assembly.

Background of the Invention

Blowout Preventer (BOP) stacks are frequently utilized in oilfield wellbore Christmas trees and subsea intervention operations. BOP stacks may include a first set of rams for sealing off the wellbore and a second set of rams for cutting pipe such as tubing, wireline and/or intervention tools. A BOP comprises two ram blocks that open and close to allow access or seal the wellbore through the BOP. Large-diameter hydraulic cylinders, normally retracted, force the two ram blocks together in the middle to seal the wellbore. The ram blocks are constructed of steel for strength and fitted with elastomer components on the sealing surfaces. The ram blocks are available in a variety of configurations. In some designs, they are flat at the mating surfaces to enable them to seal over an open wellbore. Other designs have a circular cutout in the middle that corresponds to the diameter of the pipe in the hole to seal the well when pipe is in the hole.

BOP stacks are quite bulky and heavy, and therefore, BOP stacks tend to be expensive for installation and removal due to the need for heavy lifting equipment. Moreover, if maintenance is required, then the high maintenance costs for utilizing BOP stacks for intervention purposes severely limits the wells that can be economically reworked. BOP stacks may frequently require maintenance after cutting pipe or wireline. For instance, the cut pipe or wireline may become stuck within the BOP shear rams blocking the BOP from forming a complete seal or shearing function.

Consequently, those skilled in the art will appreciate the present invention that addresses the above problems.

SUMMARY OF THE INVENTION

An object of the present invention is to provide an improved shear ram BOP assembly.

Another possible object of the present invention is to provide an improved shear ram assembly with increased shearing capabilities and seal performance.

Yet another possible object of the present invention is to provide an improved shear ram assembly that causes less damage to ram cavity during normal operation, therefore requiring less maintenance.

Yet another possible object of the present invention is to provide a plurality of angled shoulders that when engaged cause the upper and lower ram to be interlocked with each other in a manner that prevents rotation.

Yet another possible object of the present invention is to provide means that hold the rams to prevent even slight bending or rotation of the rams within the ram cavity to thereby cut better with less likelihood of jams after cutting.

One general aspect comprises a shear ram assembly mounted inside a bop (blowout preventer) for cutting drill pipe, coiled tubing, and wireline, and to seal a wellbore. The bop comprises a bore through the bop. The bop further comprises ram cavities on either side of the bore that intersect the bore.

The shear ram assembly comprises a lower ram and an upper ram that mount within the ram cavities on opposite sides of the bore through the bop. The lower ram comprises a first v-shaped cutting surface, the upper ram comprises a second v-shaped cutting surface; and a first pair of shoulders on the upper ram that include a first pair of flat planar upper ram engagement surfaces. The shear ram assembly also includes a second pair of shoulders on the upper ram that include a second pair of flat planar upper ram engagement surfaces, the first pair of flat planar upper ram engagement surfaces being angled in a different direction than the second pair of flat planar upper ram engagement surfaces. The shear ram assembly also includes a first pair of shoulders on the lower ram that include a first pair of flat planar lower ram engagement surfaces. The shear ram assembly also includes a second pair of shoulders on the lower ram that include a second pair of flat planar lower ram engagement surfaces, the first pair of flat planar lower ram engagement surfaces being angled in a different direction than the second pair of flat planar lower ram engagement surfaces. The shear ram assembly also includes the upper ram and the lower ram being moveable with respect to the bore between an open position and a closed position, where when in the closed position, the first pair of shoulders of the upper ram engage with the first pair of shoulders of the lower ram and the second pair of shoulders of the upper ram engage with the second pair of shoulders of the lower ram.

Implementations may include one or more of the following features. The shear ram assembly further comprises a top surface of the upper ram that conforms to a shape of a ram cavity wall along 90% to 100% of a length of the upper ram from a rear end of the upper ram to a center of a pipe engagement surface on a front end of the upper ram. The shear ram assembly further comprises a first pair of wear pads and a second pair of wear pads. The first and second pairs of wear pads have a length at least as long as the upper ram and the lower ram.

The first pair of flat planar lower ram engagement surfaces are angled differently than the second pair of flat planar lower ram engagement surfaces by rotation around a z-axis by an angle of from 120 to 220 degrees. The z-axis is orthogonal to a y-axis through the bore and an x-axis through the ram cavities. The shear ram assembly where the first and second v-shaped cutting surfaces have a length along the z-axis that is at least as long as a diameter of the bore through the bop. The shear ram assembly where the first pair of shoulders on the upper ram and the second pair of shoulders on the upper ram include packer material. The shear ram assembly further comprises inserts for the packer material that increase a pressure within the packer material.

BRIEF DESCRIPTION OF THE DRAWINGS

The above general description and following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Abbreviations include the following:

API—American Petroleum Institute

BOP—Blowout Preventer

BSEE—Bureau of Safety and Environmental Enforcement

MIDVS—Magnum Interlocking Dual V-Shaped Shear Ram Assembly

Figure 1A:
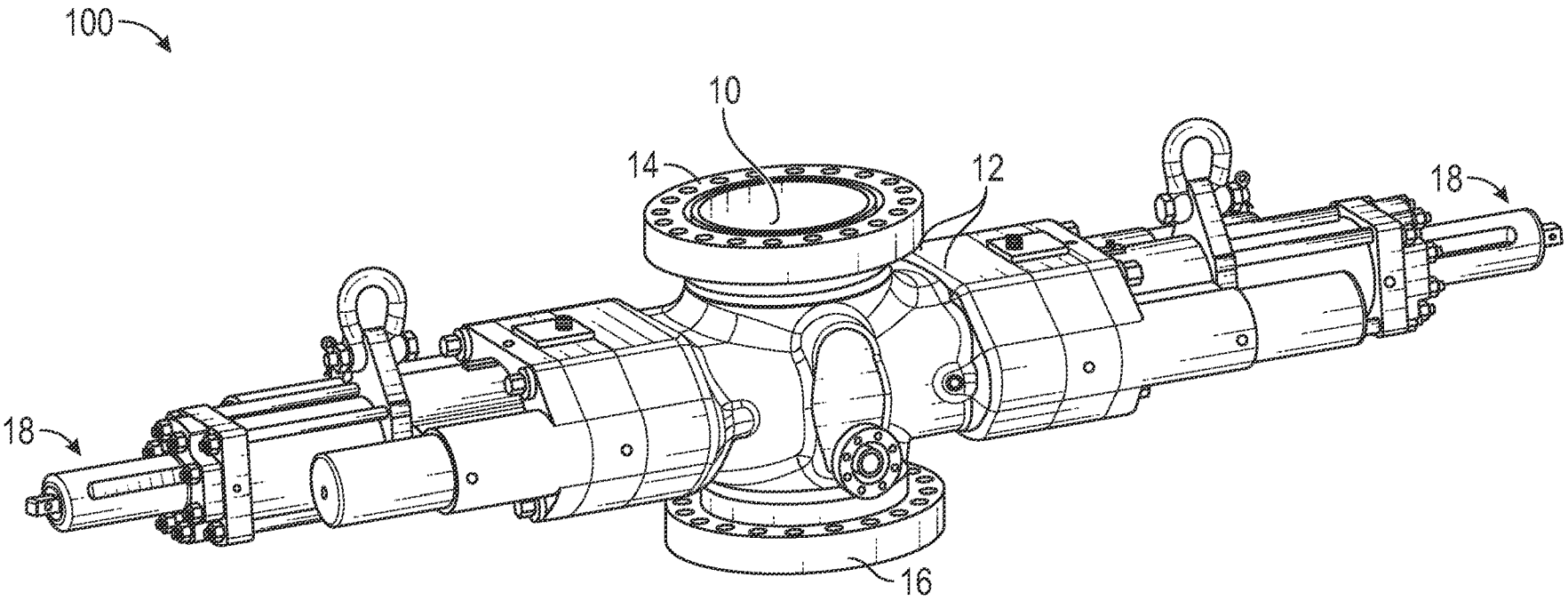
FIG. 1A is a perspective view of an interlocking dual v-shaped shear ram BOP assembly in accord with one embodiment of the present invention.
Figure 1B:
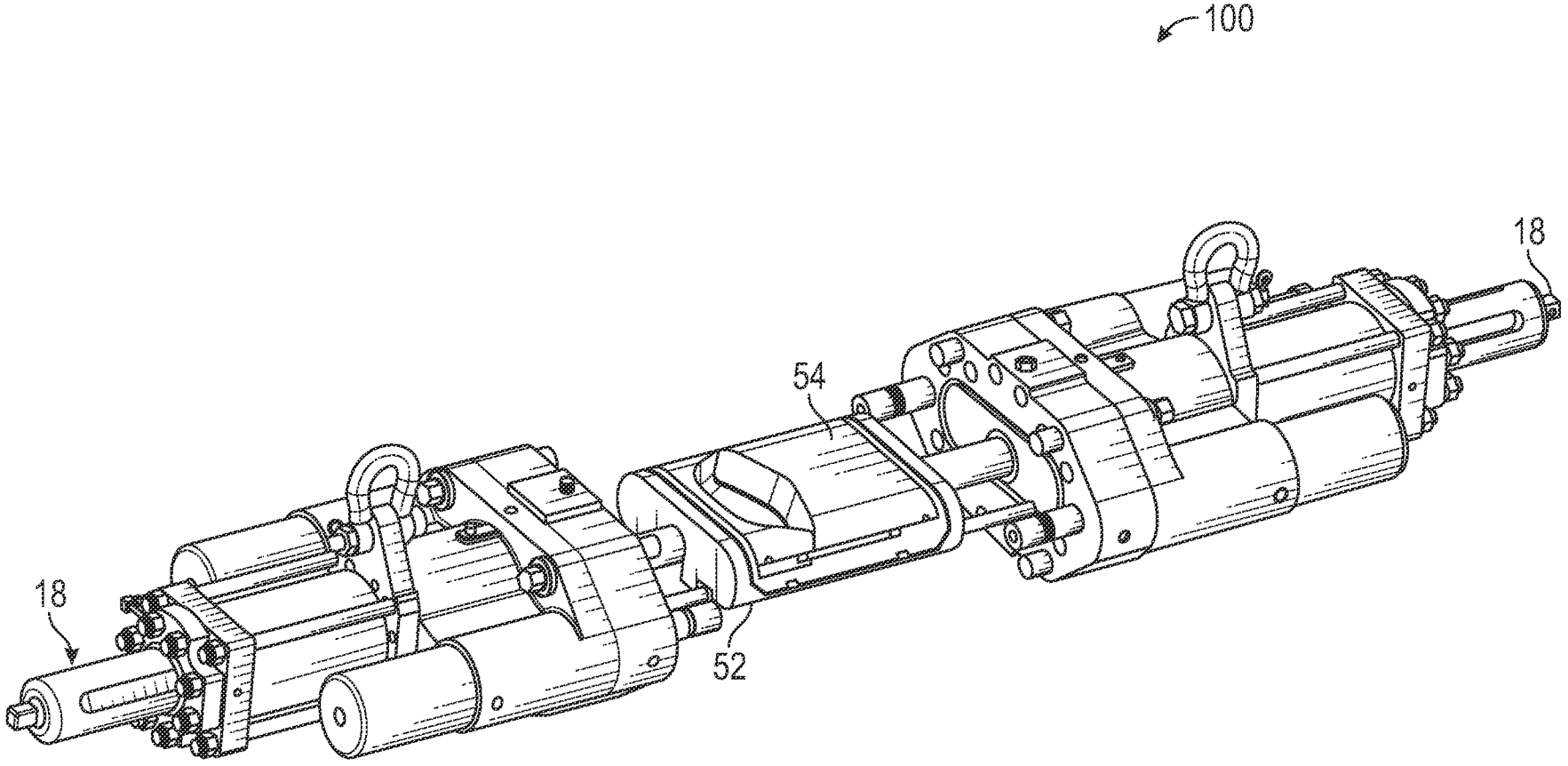
FIG. 1B is a perspective view of an interlocking dual v-shaped shear ram BOP assembly, with the BOP bore removed, in accord with one embodiment of the present invention.

The use of the present invention complies with all relevant codes and standards including:

API 16TR1;

API 16A, 4th Edition, PR2;

BSSE Well Control Rules;

Turning to FIGS. 1A & 1B, interlocking dual v-shaped shear ram BOP assembly 100 or referred to hereinafter as MIDVS 100 is shown as used in one possible embodiment of a well control intervention system. MIDVS 100 comprises housing 12 which defines an inner ram cavity that houses upper ram 54 and lower ram 52 on opposite sides of wellbore 10. Upper and lower is determined when the BOP is in the intended orientation for operation. Upper and lower flanges 14 and 16 are for connecting MIDVS 100 with other well control equipment. Two actuating means 18, which may comprise hydraulic pistons or the like, are engaged with MIDVS 100 to move upper and lower rams 52 and 54 towards and away from wellbore 10 during operation. MIDVS 100 is able to cut drill pipe, drill string, wireline or tubing when the BOP is closed, and then fully interlockingly engage within the ram cavity to provide isolation or sealing of the wellbore.

Figure 2:
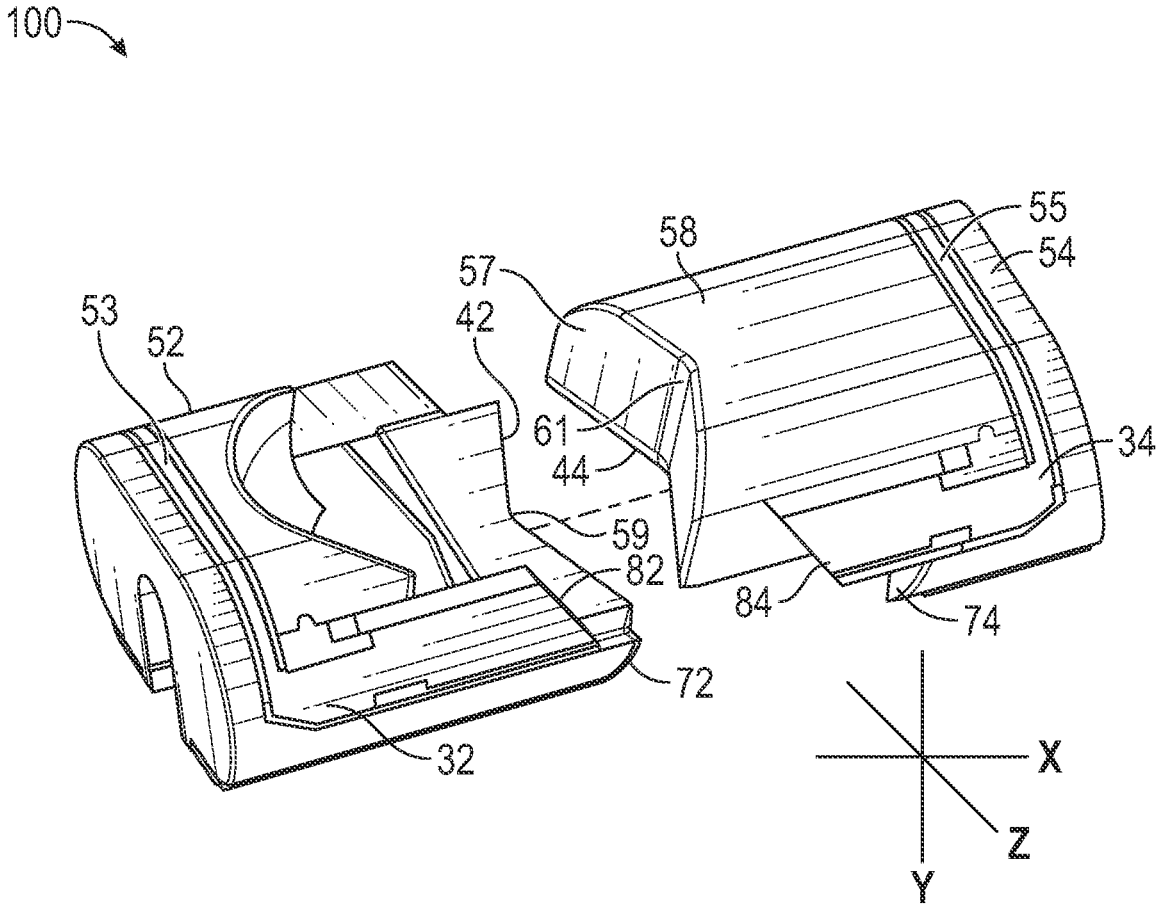
FIG. 2 is a perspective view of an interlocking dual v-shaped shear ram assembly in a separated position in accord with one embodiment of the present invention.
Figure 3A:
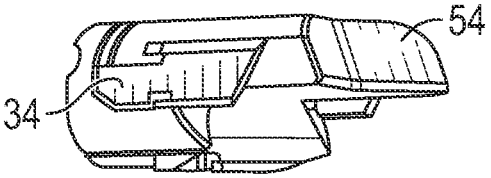
FIG. 3A shows a perspective view of an upper ram in accord with one embodiment of the present invention.
Figure 3C:
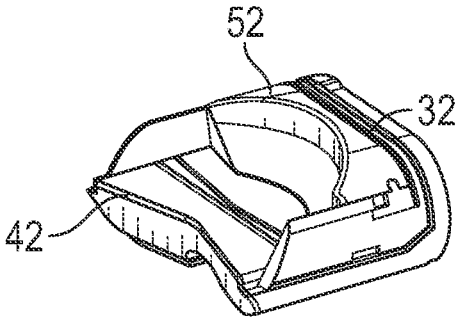
FIG. 3C shows a perspective view of a lower ram in accord with one embodiment of the present invention.
Figure 3B:
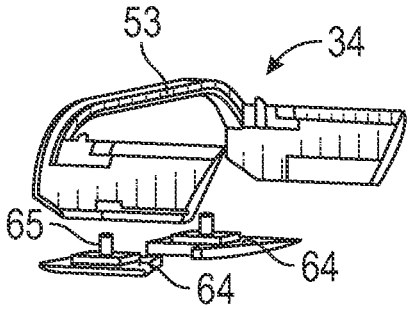
FIG. 3B shows a perspective view of an elastomeric packer and wear pads for the upper ram in accord with one embodiment of the present invention.
Figure 3D:
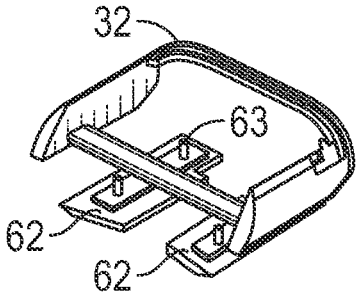
FIG. 3D shows a perspective view of an elastomeric packer and wear pads for the lower ram in accord with one embodiment of the present invention.

Looking to FIG. 2, MIDVS 100 is shown with the upper ram 54 and lower ram 52 separated and removed from housing 12. Lower cutting surface 42 and upper cutting surface 44 are two v-shaped angled cutting surfaces on each respective ram. The cutting blades 42 and 44 have a width approximately equal to the width of the corresponding ram blocks 52 and 54 and may be within one half inch, or one quarter inch or one eighth inch or one sixteenth inch of the maximum width of the ram blocks as viewed from the top. On upper ram 54, the upper cutting surface 44 and the pipe engagement surface 57 are V-shaped. Pipe engagement surface 59 on lower ram 52 may have a round surface or could also be V-shaped.

Lower packer 32 is situated in a recess of lower ram 52 and Upper packer 34 is situated within a body recess of upper ram 54. The packers are on both sides and include upper ram seal portions 53, 55 that link the two side seal portions on each side of the rams 52 and 54.

At the mating ends of rams 52 and 54, packers 32 and 34 defined wedged mating shoulders 82, 84 for both the upper and lower rams optimized to reduce extrusion gaps on the seal assembly when energized. Wedged shoulders 82, 84 comprise packer material such as elastomeric material that engages to provide a seal for the bore utilizing packers 32, 34. Upper ram first shoulder surface 84 is angled with an acute angle to an axis through the main bore or wellbore 10 through the BOP. This main bore axis may also be referred to as a y-axis. Shoulder surface 84 may face downward towards the wellbore 10. Lower ram first shoulder surface 82 forms a mating acute angle with respect to the y-axis through wellbore that may have the face oriented upwardly to mate with upper ram first shoulder surface 84. Upper ram second shoulder surface 74 is an acute angle with the face oriented downwardly and mates with lower ram second shoulder surface 72 which is angled with face pointing upwardly. This wedging arrangement prevents MIDVS 100 from rotating during a sealing engagement and provides a tighter contact surface when the seal is actuated. Each of the surfaces for pairs of shoulders 72, 74, 82, and 84 are preferably flat, planar surfaces.

Thus the metallic angled lower ram second shoulder 72 may have the face oriented downwardly in an opposite direction from the orientation of lower ram first shoulder surface 82. Likewise upper ram shoulder surface 84 is oriented in an opposite direction to upper ram second shoulder surface 74. Thus, rotation is prevented in both directions by multiple surfaces. The multiple surfaces, some of which are metal 72, 74 and others elastomeric 82 and 84, are oriented in different directions as described above and shown in FIG. 2 to form what is referred to herein as an interlocking mating connection.

One advantage of the interlocking mating connection is that the angled surfaces 72, 74, 82, 84 prevent the ram blocks 52, 54 from rotating during a pressure hold. The ram blocks are designed to bottom up against each other during a pressure hold, i.e. when the rams are closed with pressure beneath the rams. In the prior art, the upper rams will load itself on to the ram cavity and the ram cavity provides the support to prevent the ram block from rotating. This loading tends to deform the ram cavity, ever so slightly, and eventually allows the upper ram blade 44 to separate from the lower ram blade 42 and create a leak at the blade seal area where blades 42 and 44 overlap when the rams are closed. For the present invention, during a close and seal condition the rams angled surfaces wedge into each other and prevent the upper ram from rotating and transfer this load to the ram cavity and thus preventing the ram cavity wall 68 (see FIG. 5) from deformation.

Thus, upper ram 54 comprises a first and second pair of angled surfaces. Metallic angled surfaces like that of 74 shown in FIG. 2 comprises a first pair of angled surfaces on both sides of upper ram 54. Packer surfaces 84, which are non-metallic and typically elastomeric, are also formed on the upper ram 54. Likewise a first pair of angled packer surfaces 82 are provided on both sides of lower ram 52 and a second pair of metallic angled surfaces 72 are formed on both sides of lower ram 52. The angles of surfaces 82 and 84 are complimentary and opposite to each other. For example if surface 82 forms a thirty degree angle with respect to the y-axis of the throughbore of the BOP, then angle 84 mates with that surface so that the two are flushly engaged. The same applies to the angled mating surfaces 72 and 74. The angled mating metallic surfaces 72, 74 are 120 to 220 degrees different, and could be any angle therebetween, than the angled packer surfaces 82, 84. As shown in the drawings, the surfaces could be about 180 degrees different. Preferably the surfaces 72, 74 are changed in the 120 to 220 degree range by a rotation around a z-axis that is orthogonal to both the y-axis of the wellbore and what may be referred to as an x-axis through the ram cavities. It is well known and typical that the x-axis through the ram cavities is orthogonal to the y-axis through the wellbore.

Accordingly, each of surfaces 72, 82, may also be referred to as a pair of flat planar lower ram engagement surfaces and each of surfaces 74, 84 may be referred to as flat planar upper ram engagement surfaces. They are engagement surfaces because when the rams close, pairs of surfaces 72, 74 and 82, 84 engage each other. The angled engagement of packer surfaces 82, 84 also provides a seal between these packer surfaces.

Referring now to FIGS. 3A, 3B, 3C and 3D and FIGS. 4A and 4B, both upper ram 54 and lower ram 52 are shown in an exploded view depicting elastomeric packers 32 and 34 in further detail. Packer 32 is positioned on the lower ram 52 to provide a seal at any point where packer 32 on lower ram 52 may contact upper ram 54 or ram cavity wall 68. Similarly, packer 34 is positioned on the upper ram 54 to provide a seal when energized by closing the rams at any point where packer 34 on upper ram 54 may contact ram cavity wall 68. For example, surfaces 82 and 84 seal against each other when energized due to closing the rams. Packers 32 and 34 are used in the rams for sealing off pressure below the rams when the rams are closed.

The pair of wear pads 62 and 64 may be utilized along the full length of the lower side portions of upper ram 54 and lower ram 52, respectively, to prevent deformation of the ram cavity 68 during use. Wear pads 62 and 64 are softer metal than the metal of the ram body in the ram cavities. In some embodiments, wear pad 62 has post 63 which engages a lower recess on lower ram 54 to fix the placement, and wear pad 64 defines post 65 which engages with a lower recess on upper ram 52. Wear Pads 62 and 64 keep the correct distance between the ram cutting edges to shear wire line. In some embodiments, shims and other height adjustment members may be used to further provide an improved seal. In a preferred embodiment, wear pads 62 and 64 are metallic, but could be composed of other materials.

Figure 4A:
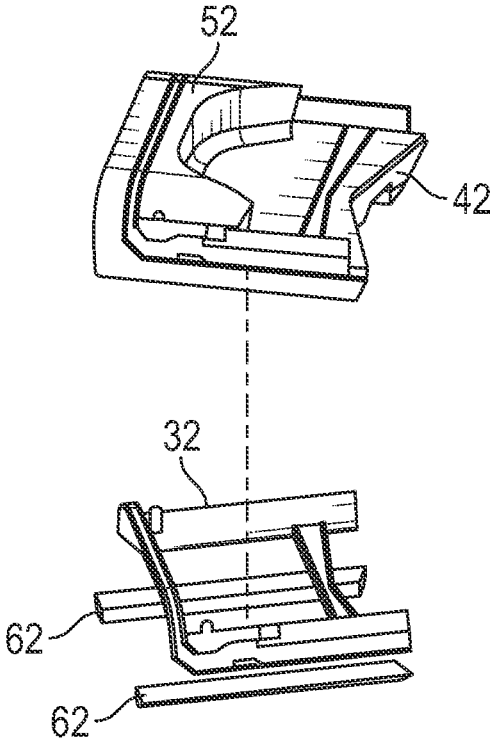
FIG. 4A shows another perspective view of an upper ram and packer in accord with one embodiment of the present invention.
Figure 4B:
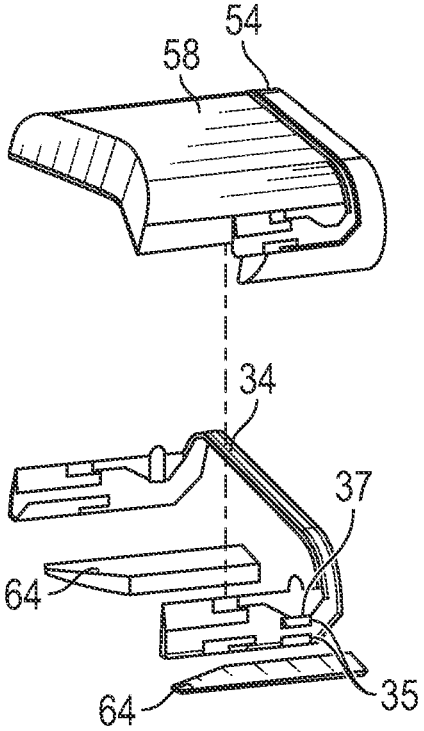
FIG. 4B shows another perspective view of an elastomeric packer and wear pads for the lower ram in accord with one embodiment of the present invention.

Referring to FIG. 4B, inserts 35 of generally harder material than the packer material 37 may be used in the packer material of packers 32 and 34 to increase the elastomer stored energy (Rubber pressure) resulting in a more homogeneous energy state. This concept is similar to an "O" ring with back-up rings. In this way, the elastomeric material of the packers may be made narrower and/or effect better seals under pressure with less likelihood of damage. In this case, elastomeric packer material 35 is positioned between two inserts 37 that are harder than the elastomeric packer material. This configuration is shown for only a small portion of the packer 34 but may be utilized throughout the packer 34 so that the inserts 37 form a lining for the whole or most of packer 34 and/or packer 32.

Figure 5:
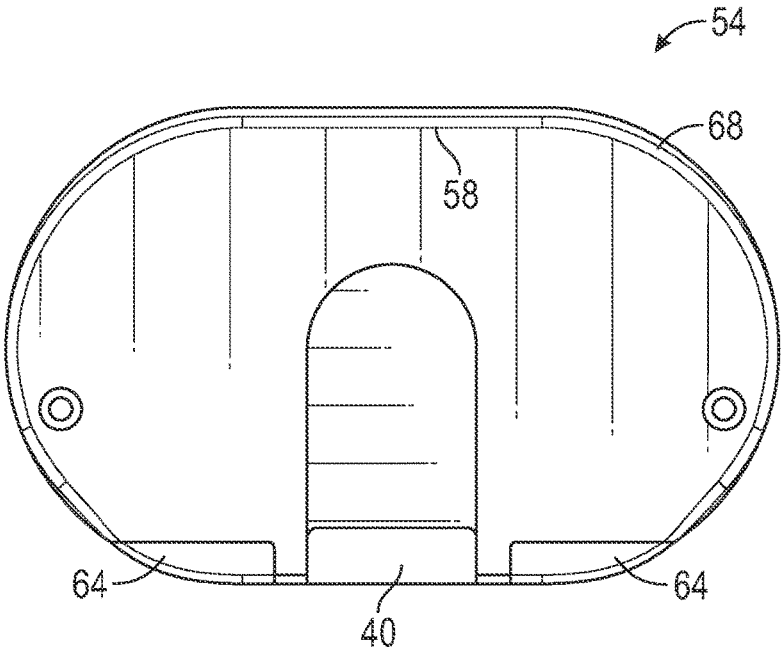
FIG. 5 is a side view of an interlocking dual v-shaped shear ram assembly in accord with one embodiment of the present invention.
Figure 6A:
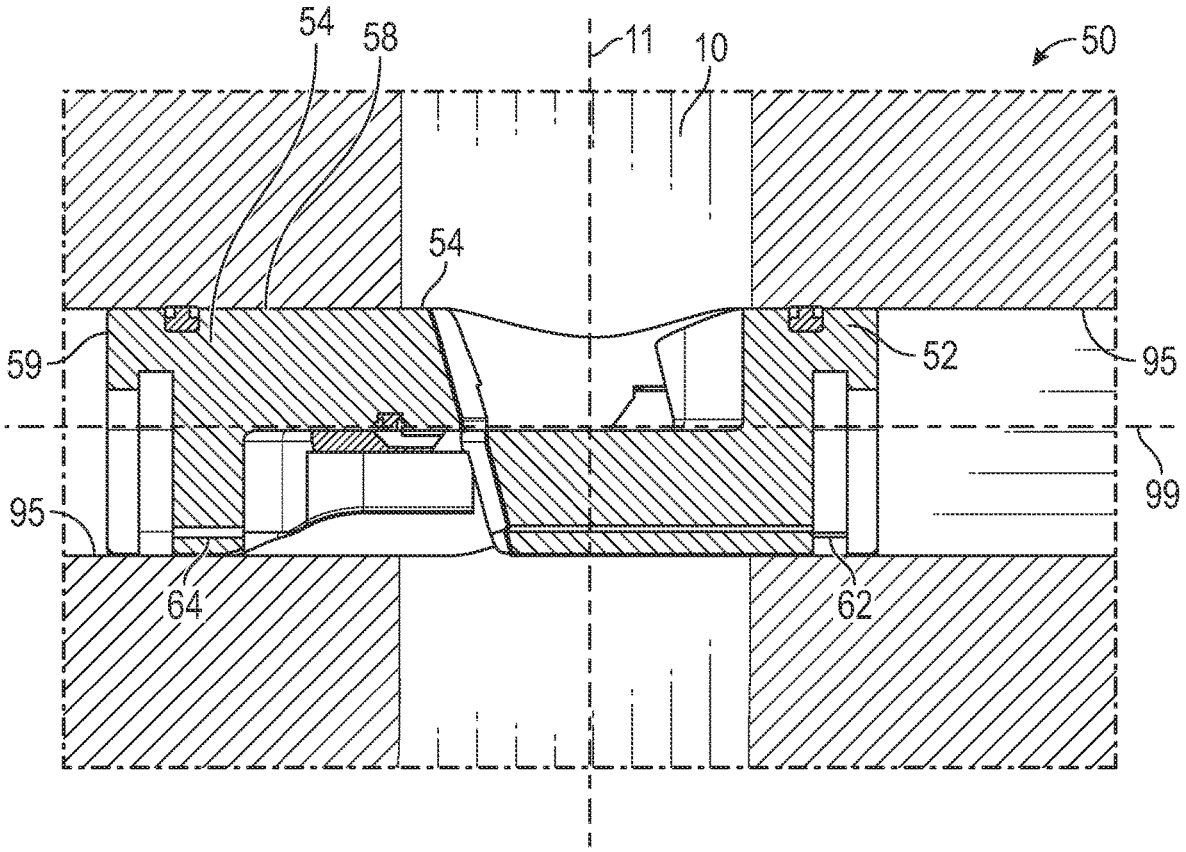
FIG. 6A is a sectional view of an interlocking dual v-shaped shear ram assembly in a sealing arrangement in accord with one embodiment of the present invention.
Figure 6B:
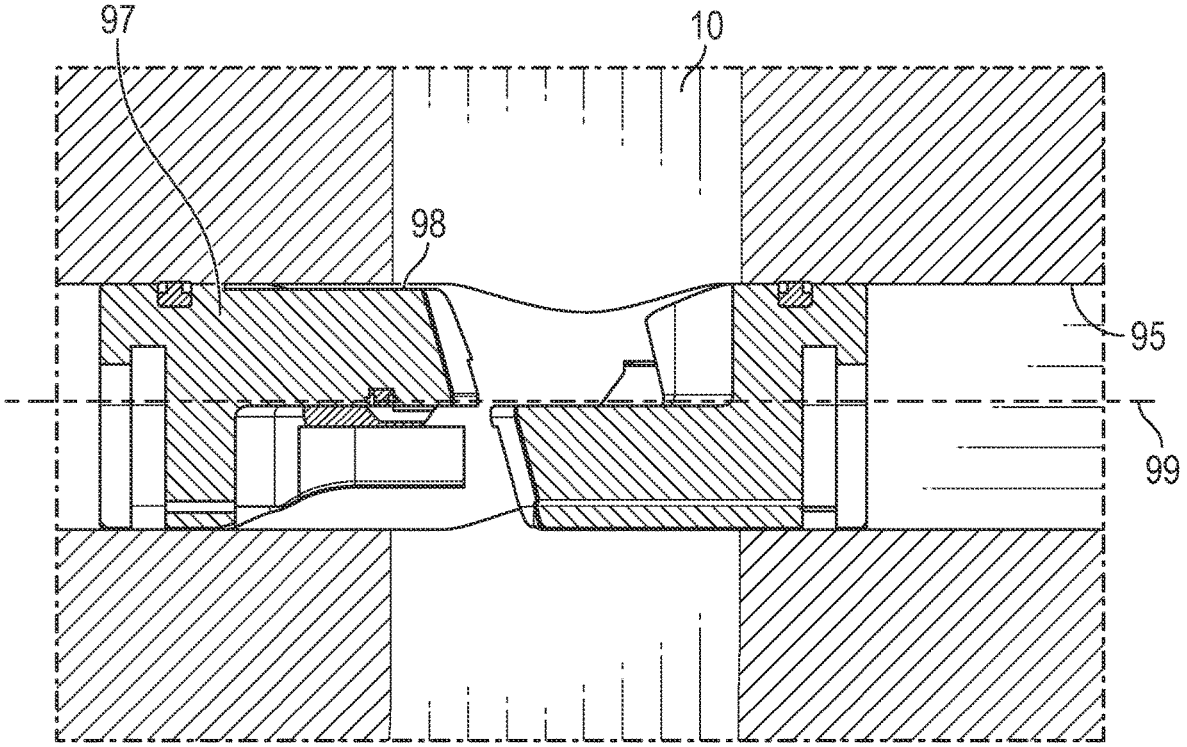
FIG. 6B (Prior Art)
FIG. 6B is a sectional view of a prior art shear ram assembly.

Turning to FIG. 5, a side view of upper ram 54 is shown in the ram cavity 95 with a constant body definition on the top of the upper ram block and recess 40 on a lower end of upper ram 54. The rams move in parallel with ram cavity axis 99. Prior art upper rams utilize a recess 98 as shown for prior art upper ram 97 in FIG. 6B. The advantage of not having a recessed upper ram block, with recess 98 at the top of the ram, is that it will prevent the ram block blade from separating during a wire line cut. If the blades separate during a wire line cut, the wire line elongates or stretches rather than shears. The slight bending of prior art upper ram block 97 due to recess 98 in FIG. 6B is shown in comparison to the unbent upper ram block 54 in FIG. 6A. In the prior art ram block 97, elongated wire line will get stuck in the blade seal and prevent a pressure hold. Removing this recess allows upper ram 54 to gain more support from inner ram cavity wall 68 for the ram to keep the gap between the blades sufficiently small to cut wire line cleanly.

Wear pads 64 engage inner cavity wall 68 at the points where force is most likely to deform or damage the ram cavity to further prevent bending of upper ram block 54. Accordingly, top surface 58 conforms to the shape of ram cavity wall 68 along the entire length of upper ram block 54 as shown in FIG. 5 and FIG. 6A. In one preferred embodiment top surface 58 conforms to a shape of ram cavity wall 68 along 90% to 100% of a length of upper ram 54 from a rear end 59 to the center 61 (See FIG. 2) of the V-shaped pipe engagement surface 57 on the front end of the upper ram.

Figure 6C:
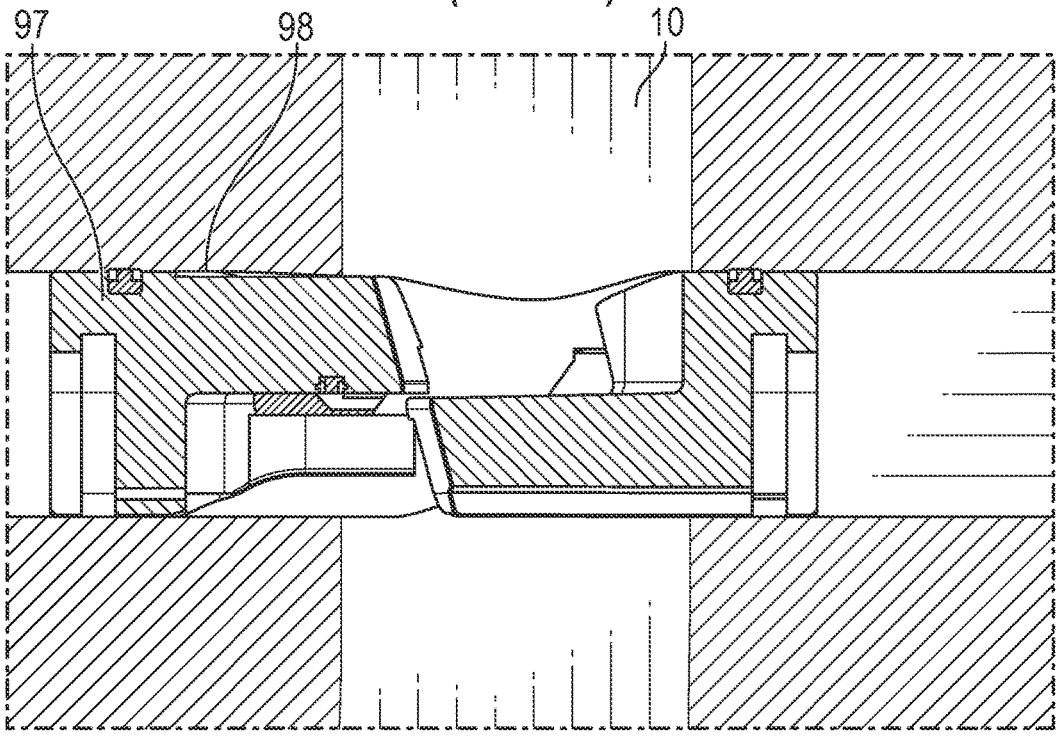
FIG. 6C (Prior Art)
FIG. 6C is another sectional view of a prior art shear ram assembly.

In FIG. 6A, dual v-shaped shear ram assembly 100 is shown with both upper ram block 54 and lower ram block 52 engaged in the throughbore 10. The side cross-sectional view of upper surface 58 that intersects the throughbore 10 is a straight line rather a straight line with a recessed portion 98 in upper ram 97 as shown in FIG. 6B. Wear pads 62 and 64 form angled surfaces on bottom of the rams also act to prevent the upper ram from rotating and/or bending during a pressure hold as shown in FIG. 6C. This rotation and/or bending occurs as a result of the recessed portion 98 on upper ram block 97 as shown in FIG. 6B depicting prior art rams and described herein where discussing FIG. 5.

Figure 7A:
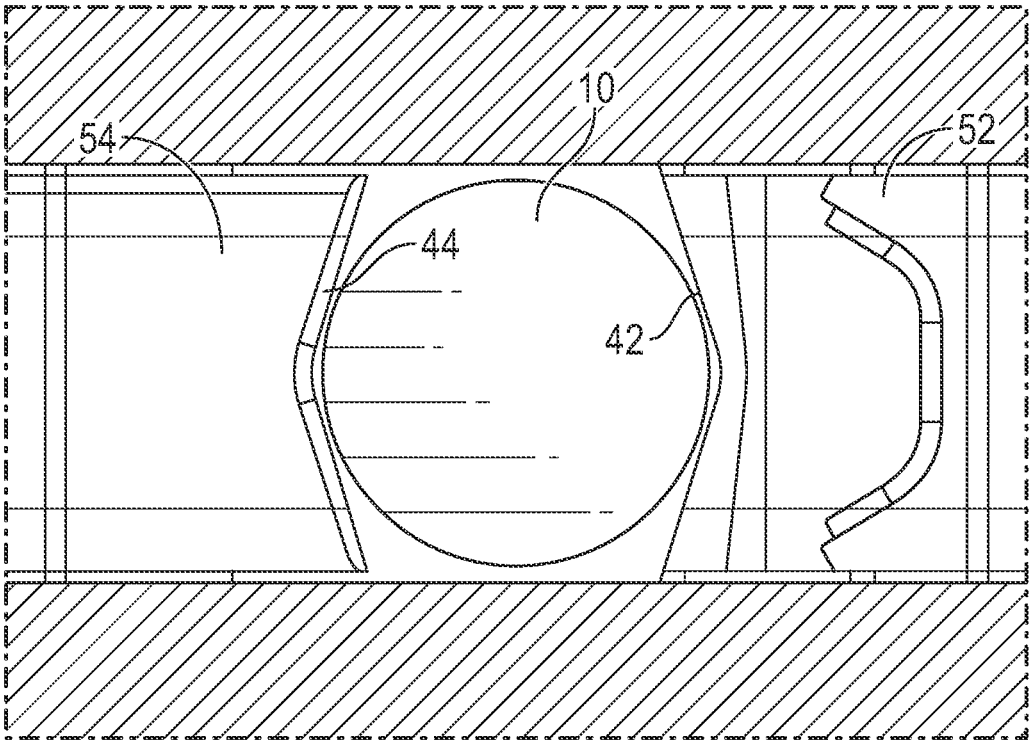
FIG. 7A is a top view of an interlocking dual v-shaped shear ram assembly in accord with one embodiment of the present invention.
Figure 7B:
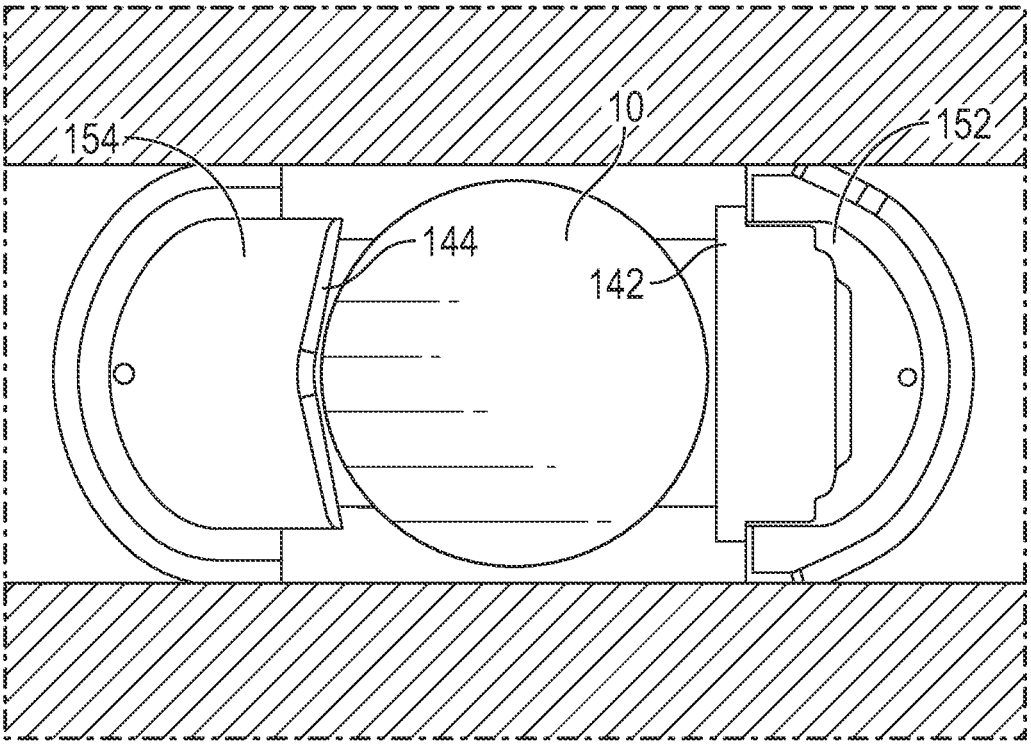
FIG. 7B (Prior Art)
FIG. 7B is a top view of a prior art shear ram assembly.
Figure 8A:
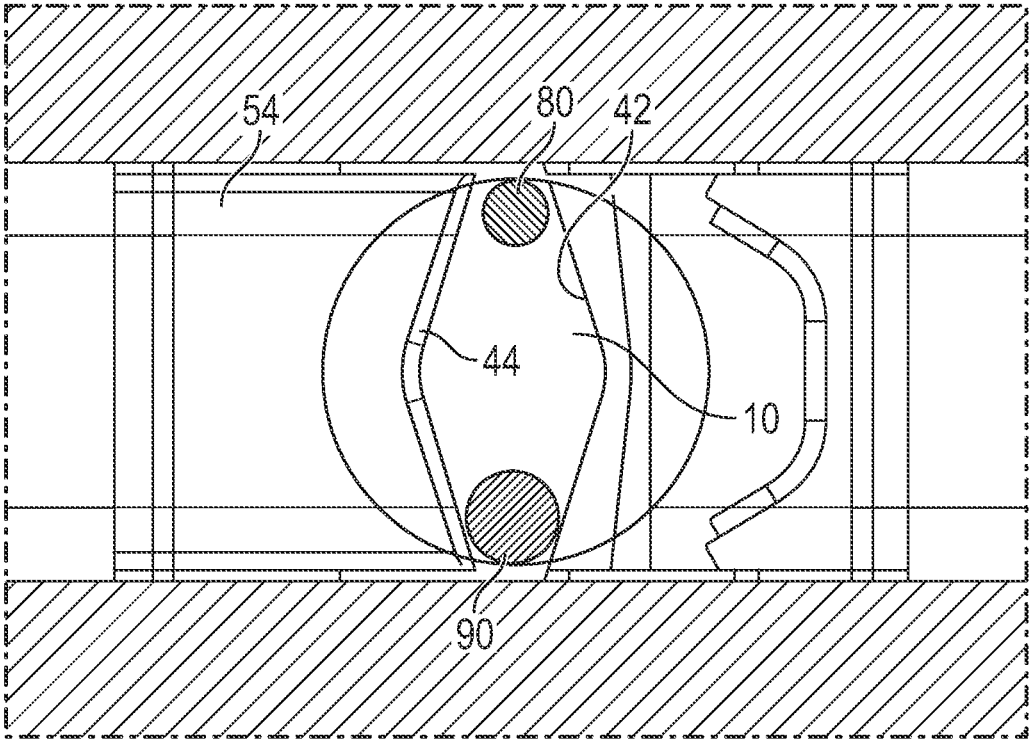
FIG. 8A is a top view of an interlocking dual v-shaped shear ram assembly with pipe in BOP bore in accord with one embodiment of the present invention.

Dual interlocking v-shaped shear ram assembly 100 provides coverage of the entire well bore diameter using a full length blade to cover the BOP's through bore diameter for type U BOP as shown in FIGS. 7A & 8A. By full length it is meant that blades 44 and 42 are sized the same size and/or larger than bore 10 diameter as shown in FIG. 7A. FIG. 7B shows the smaller width blades 144, 142 of prior art rams 152, 154. Therefore, cutting surfaces 42 and 44 have sufficient length to cover the entire diameter of wellbore 10. This allows the rams to shear tubing and wire line, even if the items in the bore 10 to be cut are offset in relation to the center of the well bore, as well as provide a full seal.

Figure 8B:
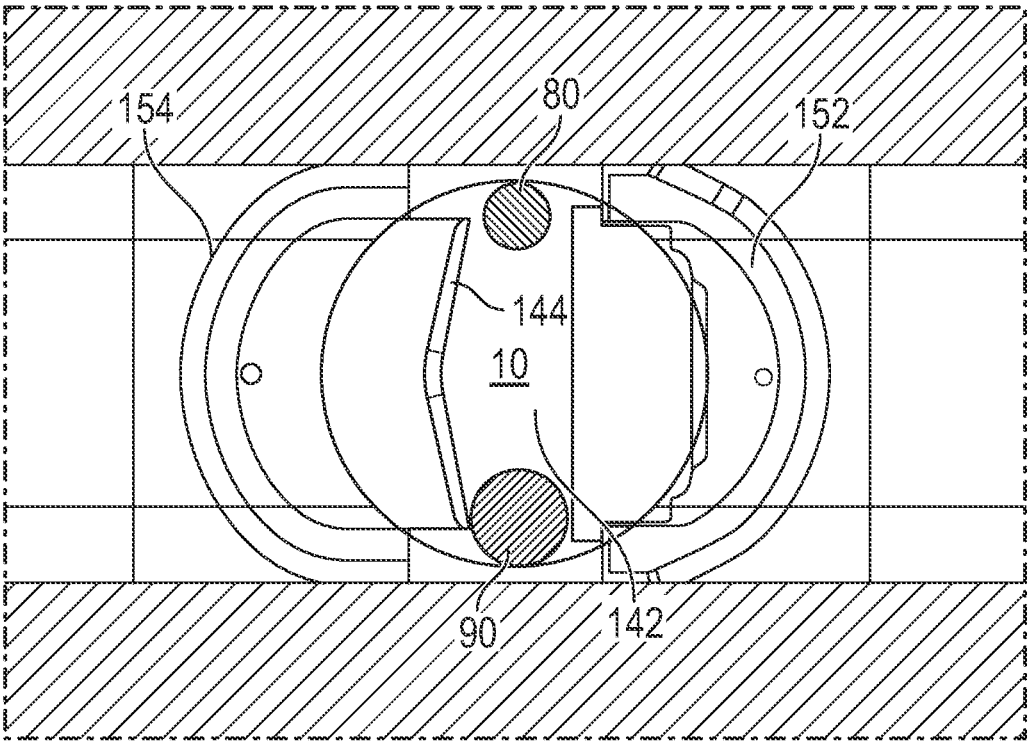
FIG. 8B (Prior Art)
FIG. 8B is a top view of a prior art shear ram assembly with pipe in BOP wellbore.

Looking to FIGS. 8A and 8B, 3.5 in pipe 80 and 5 in pipe 90 are offset from the center axis of wellbore 10. Prior art blades 144 and 142 fail to cover the entire wellbore 10 which causes pipe 80 and pipe 90 to only partially shear. Prior art shear rams are not as effective to provide shearing or sealing capabilities for offset pipe or tubing in the well bore, as blades 144 and 142 do not encompass the entire diameter of well bore 10 as shown in FIGS. 7B & 8B.

In summary, the present invention provides a dual interlocking v-shaped shear ram assembly comprising an upper ram packer and lower ram packer, each defining a v-shaped cutting surface. In a preferred embodiment, the upper cutting surface and lower cutting surface surround the throughbore in the open position. During operation, the shear ram will cut any drill pipe, drill string, wireline, or other tubulars present in the wellbore. In the closed position, first and second angled shoulders 74, 84 on upper ram 54 and first and second shoulders 72, 82 on lower ram 52 engage to for an interlocking position to seal the wellbore and prevent rotation in the ram cavity.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A shear ram assembly mounted inside a BOP (blowout preventer) for cutting drill pipe, coiled tubing, and wireline, and to seal a wellbore, said BOP comprising a bore through said BOP, said BOP further comprising ram cavities on either side of said bore, said ram cavities intersecting with said bore, said shear ram assembly comprising:

a lower ram and an upper ram that mount within said ram cavities on opposite sides of said bore through said BOP, said lower ram comprising a first v-shaped cutting surface, said upper ram comprising a second v-shaped cutting surface; and a first pair of shoulders on said upper ram that comprise a first pair of flat planar upper ram engagement surfaces;

a second pair of shoulders on said upper ram that comprise a second pair of flat planar upper ram engagement surfaces, said first pair of flat planar upper ram engagement surfaces being angled in a different direction than said second pair of flat planar upper ram engagement surfaces;

a first pair of shoulders on said lower ram that comprise a first pair of flat planar lower ram engagement surfaces;

a second pair of shoulders on said lower ram that comprise a second pair of flat planar lower ram engagement surfaces, said first pair of flat planar lower ram engagement surfaces being angled in a different direction than said second pair of flat planar lower ram engagement surfaces;

said upper ram and said lower ram being moveable with respect to said bore between an open position and a closed position, whereby when in said closed position, said first pair of shoulders of said upper ram engage with said first pair of shoulders of said lower ram and said second pair of shoulders of said upper ram engage with said second pair of shoulders of said lower ram; and said first pair of flat planar lower ram engagement surfaces being angled differently than said second pair of flat planar lower ram engagement surfaces by rotation around a z-axis orthogonal to a y-axis through said bore and an x-axis through said ram cavities by an angle of from 120 to 220 degrees.

2. The shear ram assembly of claim 1, further comprising a top surface of said upper ram that conforms to a shape of a ram cavity wall along 90% to 100% of a length of said upper ram from a rear end of said upper ram to a center of a pipe engagement surface on a front end of said upper ram.

3. The shear ram assembly of claim 1, further comprising a first pair of wear pads and a second pair of wear pads, said first and second pairs of wear pads having a length at least as long as said upper ram and said lower ram.

4. The shear ram assembly of claim 1, wherein said first and second v-shaped cutting surfaces have a length along said z-axis that is at least as long as a diameter of said bore through said BOP.

5. The shear ram assembly of claim 1, wherein said first pair of shoulders on said upper ram and said second pair of shoulders on said upper ram comprise packer material for an upper ram packer and a lower ram packer.

6. The shear ram assembly of claim 5, further comprising inserts for said packer material that increase a pressure within said packer material, said inserts being positioned within at least one of said upper ram packer or said lower ram packer.

7. The shear ram assembly of claim 6, wherein said inserts are positioned on either side of said packer material.

8. A shear ram assembly mounted inside a BOP (blowout preventer) for cutting drill pipe, coiled tubing, and wireline, and to seal a wellbore, said BOP comprising a bore through said BOP, said BOP further comprising ram cavities on either side of said bore, said ram cavities intersecting with said bore, said shear ram assembly comprising:

a lower ram and an upper ram that mount within said ram cavities on opposite sides of said bore through said BOP, said lower ram comprising a first v-shaped cutting surface, said upper ram comprising a second v-shaped cutting surface; and a first pair of shoulders on said upper ram that comprise a first pair of flat planar upper ram engagement surfaces;

a second pair of shoulders on said upper ram that comprise a second pair of flat planar upper ram engagement surfaces, said first pair of flat planar upper ram engagement surfaces being angled in a different direction than said second pair of flat planar upper ram engagement surfaces;

a first pair of shoulders on said lower ram that comprise a first pair of flat planar lower ram engagement surfaces;

a second pair of shoulders on said lower ram that comprise a second pair of flat planar lower ram engagement surfaces, said first pair of flat planar lower ram engagement surfaces being angled in a different direction than said second pair of flat planar lower ram engagement surfaces;

said upper ram and said lower ram being moveable with respect to said bore between an open position and a closed position, whereby when in said closed position, said first pair of shoulders of said upper ram engage with said first pair of shoulders of said lower ram and said second pair of shoulders of said upper ram engage with said second pair of shoulders of said lower ram; and wherein said first pair of shoulders on said upper ram and said second pair of shoulders on said upper ram comprise packer material for an upper ram packer and a lower ram packer.

9. The shear ram assembly of claim 8, further comprising a top surface of said upper ram that conforms to a shape of a ram cavity wall along 90% to 100% of a length of said upper ram from a rear end of said upper ram to a center of a pipe engagement surface on a front end of said upper ram.

10. The shear ram assembly of claim 8, further comprising a first pair of wear pads and a second pair of wear pads, said first and second pairs of wear pads having a length at least as long as said upper ram and said lower ram.

11. The shear ram assembly of claim 8, further comprising inserts for said packer material that increase a pressure within said packer material, said inserts being positioned within at least one of said upper ram packer or said lower ram packer.

12. The shear ram assembly of claim 11, wherein said inserts are positioned on either side of said packer material.

13. A shear ram assembly mounted inside a BOP (blowout preventer) for cutting drill pipe, coiled tubing, and wireline, and to seal a wellbore, said BOP comprising a longitudinal bore through said BOP defining a y-axis, said BOP further comprising ram cavities on either side of said longitudinal bore, an x-axis extending through said ram cavities perpendicular to the y-axis, said ram cavities intersecting with said longitudinal bore, and a z-axis perpendicular to the x-axis and the y-axis, said shear ram assembly comprising:

a lower ram and an upper ram that mount within said ram cavities on opposite sides of said longitudinal bore through said BOP, said lower ram comprising a first v-shaped cutting surface, said upper ram comprising a second v-shaped cutting surface;

a first pair of shoulders on said upper ram that comprise a first pair of flat planar upper ram engagement surfaces, wherein the first pair of shoulders does not overlap with the second v-shaped cutting surface along the z-axis;

a second pair of shoulders on said upper ram that comprise a second pair of flat planar upper ram engagement surfaces, said first pair of flat planar upper ram engagement surfaces being angled in a different direction than said second pair of flat planar upper ram engagement surfaces;

a first pair of shoulders on said lower ram that comprise a first pair of flat planar lower ram engagement surfaces;

a second pair of shoulders on said lower ram that comprise a second pair of flat planar lower ram engagement surfaces, said first pair of flat planar lower ram engagement surfaces being angled in a different direction than said second pair of flat planar lower ram engagement surfaces; and said upper ram and said lower ram being moveable with respect to said longitudinal bore between an open position and a closed position, whereby when in said closed position, said first pair of shoulders of said upper ram engage with said first pair of shoulders of said lower ram and said second pair of shoulders of said upper ram engage with said second pair of shoulders of said lower ram.

14. The shear ram assembly of claim 13, further comprising a top surface of said upper ram that conforms to a shape of a ram cavity wall along 90% to 100% of a length of said upper ram from a rear end of said upper ram to a center of a pipe engagement surface on a front end of said upper ram.

15. The shear ram assembly of claim 13, further comprising a first pair of wear pads and a second pair of wear pads, said first and second pairs of wear pads having a length at least as long as said upper ram and said lower ram.

16. The shear ram assembly of claim 13, further comprising said first pair of flat planar lower ram engagement surfaces being angled differently than said second pair of flat planar lower ram engagement surfaces by rotation around a z-axis orthogonal to a y-axis through said longitudinal bore and an x-axis through said ram cavities by an angle of from 120 to 220 degrees.

17. The shear ram assembly of claim 16, wherein said first and second v-shaped cutting surfaces have a length along said z-axis that is at least as long as a diameter of said longitudinal bore through said BOP.

18. The shear ram assembly of claim 13, wherein said first pair of shoulders on said upper ram and said second pair of shoulders on said upper ram comprise packer material for an upper ram packer and a lower ram packer.

19. The shear ram assembly of claim 18, further comprising inserts for said packer material that increase a pressure within said packer material, said inserts being positioned within at least one of said upper ram packer or said lower ram packer.

20. The shear ram assembly of claim 19, wherein said inserts are positioned on either side of said packer material.

21. A shear ram assembly mounted inside a BOP (blowout preventer) for cutting drill pipe, coiled tubing, and wireline, and to seal a wellbore, said BOP comprising a longitudinal bore through said BOP defining a y-axis, said BOP further comprising ram cavities on either side of said longitudinal bore, an x-axis extending through said ram cavities perpendicular to the y-axis, said ram cavities intersecting with said longitudinal bore, and a z-axis perpendicular to the x-axis and the y-axis, said shear ram assembly comprising:

a lower ram and an upper ram that mount within said ram cavities on opposite sides of said longitudinal bore through said BOP, said lower ram comprising a first v-shaped cutting surface, said upper ram comprising a second v-shaped cutting surface;

a first pair of shoulders on said upper ram that comprise a first pair of flat planar upper ram engagement surfaces, wherein the first pair of shoulders overlaps with at least a portion of the second v-shaped cutting surface along the y-axis;

a second pair of shoulders on said upper ram that comprise a second pair of flat planar upper ram engagement surfaces, said first pair of flat planar upper ram engagement surfaces being angled in a different direction than said second pair of flat planar upper ram engagement surfaces;

a first pair of shoulders on said lower ram that comprise a first pair of flat planar lower ram engagement surfaces;

a second pair of shoulders on said lower ram that comprise a second pair of flat planar lower ram engagement surfaces, said first pair of flat planar lower ram engagement surfaces being angled in a different direction than said second pair of flat planar lower ram engagement surfaces; and said upper ram and said lower ram being moveable with respect to said longitudinal bore between an open position and a closed position, whereby when in said closed position, said first pair of shoulders of said upper ram engage with said first pair of shoulders of said lower ram and said second pair of shoulders of said upper ram engage with said second pair of shoulders of said lower ram;

The shear ram assembly of claim 13, further comprising a top surface of said upper ram that conforms to a shape of a ram cavity wall along 90% to 100% of a length of said upper ram from a rear end of said upper ram to a center of a pipe engagement surface on a front end of said upper ram.

22. The shear ram assembly of claim 21, further comprising a first pair of wear pads and a second pair of wear pads, said first and second pairs of wear pads having a length at least as long as said upper ram and said lower ram.

23. The shear ram assembly of claim 21, further comprising said first pair of flat planar lower ram engagement surfaces being angled differently than said second pair of flat planar lower ram engagement surfaces by rotation around a z-axis orthogonal to a y-axis through said longitudinal bore and an x-axis through said ram cavities by an angle of from 120 to 220 degrees.

24. The shear ram assembly of claim 23, wherein said first and second v-shaped cutting surfaces have a length along said z-axis that is at least as long as a diameter of said longitudinal bore through said BOP.

25. The shear ram assembly of claim 21, wherein said first pair of shoulders on said upper ram and said second pair of shoulders on said upper ram comprise packer material for an upper ram packer and a lower ram packer.

26. The shear ram assembly of claim 25, further comprising inserts for said packer material that increase a pressure within said packer material, said inserts being positioned within at least one of said upper ram packer or said lower ram packer.

27. The shear ram assembly of claim 26, wherein said inserts are positioned on either side of said packer material.

* * * * *